United States Patent [19]

Brammall

[11] Patent Number: 4,690,443

[45] Date of Patent: Sep. 1, 1987

[54] LOCKING DEVICE WITH SPLIT COLLAR

[75] Inventor: Terrence N. Brammall, Angola, Ind.

[73] Assignee: Trans-Guard Industries, Inc., Angola, Ind.

[21] Appl. No.: 727,601

[22] Filed: Apr. 25, 1985

Related U.S. Application Data

[63] Continuation of Ser. No. 500,323, Jun. 2, 1983, abandoned.

[51] Int. Cl.[4] ..... B65D 33/34

[52] U.S. Cl. ..... 292/307 R

[58] Field of Search ..... 292/307 R, 327, 318, 292/319, 320, 322, 324

[56] References Cited

U.S. PATENT DOCUMENTS

| | | | |
|---|---|---|---|
| 942,314 | 12/1909 | Elliott | 292/319 |
| 961,069 | 6/1910 | Crudginton | 292/319 |
| 1,397,101 | 11/1921 | Kelly | 292/327 |
| 1,549,742 | 8/1925 | Brune, Sr. | 292/320 |
| 2,228,738 | 1/1941 | Thomson | 292/327 |
| 3,600,027 | 8/1971 | Noland | 292/322 |
| 3,730,578 | 5/1973 | Gerlach | 292/318 |
| 3,975,040 | 8/1976 | Van Gompel . | |
| 3,980,337 | 9/1976 | Moberg et al. | 292/319 |

FOREIGN PATENT DOCUMENTS

| | | | |
|---|---|---|---|
| 357459 | 8/1922 | Fed. Rep. of Germany | 292/319 |

*Primary Examiner*—Richard E. Moore

*Attorney, Agent, or Firm*—Carella, Byrne, Bain & Gilfillan

[57] ABSTRACT

A locking device is provided including a lock body and an elongate member which may be locked together. The elongate member includes a neck portion and on its end supports a head. The lock body includes a body member having an annular recess therein with a retainer having a hole therethrough and fixed to the body to overlie the recess. A pair of locking jaws are supported above the bottom of the recess and are biased together. In one aspect of the invention, the recess is tiered to define a shoulder upon which the locking jaws rest. An elastic O ring extends around the locking jaws to bias them together. In another aspect of the invention, a U-spring on the upper ends of its legs supports the locking jaws, and the U-spring is supported by a shoulder defined above the bottom of the recess.

11 Claims, 17 Drawing Figures

LOCKING DEVICE WITH SPLIT COLLAR

This application is a continuation of application Ser. No. 500,323, filed Jun. 2, 1983, now abandoned.

TECHNICAL FIELD

This invention relates to locking devices and more particularly to a lock with a split collar.

BACKGROUND ART

Locking devices are known utilizing a bolt or cable having a locking portion on the end which is receivable within a second member having a plurality of snap rings, one of which closes over a shoulder of the locking portion to prevent its retraction. Such a device is shown, for example, in U.S. Pat. No. 3,975,040.

Such devices, however, have permitted the entry of small picking tools or the like, thereby making them susceptible to being picked. Accordingly, the locks provide limited security only, particularly in those uses where it is essential that any unauthorized entry be apparent. Still further, such devices in the prior art have been expensive to manufacture, a particular drawback for devices such as this which have limited reusability.

The present invention is directed toward overcoming one or more of the problems as set forth above.

SUMMARY OF THE INVENTION

A locking device is provided having a lock body and an elongate member which may be locked together. The elongate member includes a neck portion having a first diameter and on its end supports a head having a second diameter greater than the first diameter to define a flat shoulder therebetween. The lock body includes a body member having an annular recess therein with a retainer having a hole therethrough and fixed to the body to overlie the recess. A pair of locking jaws in the form of a split collar or washer are supported above the bottom of the recess and are biased together.

In one aspect of this invention, the recess is tiered to define a shoulder upon which the locking jaws rest. An elastic O ring extends around the locking jaws to bias them together.

In another aspect of the invention, a U-spring on the upper ends of its legs supports the locking jaws, and the U-spring is supported by a shoulder defined above the bottom of the recess.

With the present invention, secure locking is provided between the elongate member and the lock body to securely guard against any unauthorized entries. The locking device may be simply and inexpensively manufactured to provide a simple yet effective locking device. The locking device is virtually pickproof and may not be opened once locked without destroying some portion of the device, thereby leaving visual evidence of any unauthorized openings.

DESCRIPTION OF THE PREFERRED EMBODIMENTS

Described hereafter are six different embodiments of the locking device. Each locking device includes a body member having a lock body structure and an elongate member which may be locked into the lock body structure to form a lock or seal. Although the body member generally varies depending upon the particular locking device, there are basically two lock body structures, either of which may be used with the body member of any of the six locking device embodiments.

Figure 1:
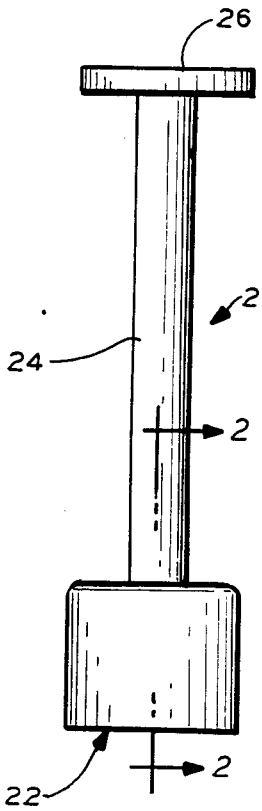
FIG. 1 is a view of one embodiment of the locking device.

Turning now to the Figures, one embodiment **20*a* of the locking device is shown locked in FIG. 1. The locking device 20*a* includes a body member 22 and a bolt member 24 which may be locked to the body member 22 as will be detailed hereafter. An enlarged end 26 is fixed to the upper end of the bolt member 24 so that when the bolt member 24 is extended through two objects, the objects (e.g. a latch) are locked together over the bolt member 24 between the enlarged end 26 and the body member 22**.

Figure 2:
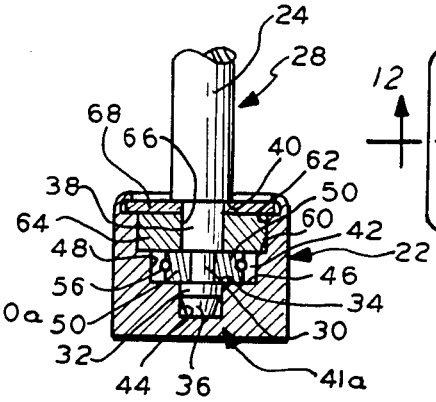
FIG. 2 is a cross-sectional view of a first embodiment of a lock body taken along line 2—2 of FIG. 1.

As seen in FIG. 2, the lower end 28 of the bolt member 24 includes a neck portion 30 having a first diameter with a head 32 secured thereto. The head 32 has a second diameter greater than the first diameter to thereby define a shoulder 34 with respect to the neck portion 30 and has a tapered portion 36 on its end. The bolt member neck portion 30 is fixed to an upper portion 38 having a diameter preferably at least as large as the end (second) diameter for a reason which will become apparent. In the preferred embodiment as shown, the bolt member 24 above the upper portion 38 has a diameter which is greater than the diameter of the upper portion 38 to define a downwardly facing shoulder 40 for a reason which will also become apparent.

A first embodiment of the lock body structure 41a of the body member 22 is shown in FIG. 2. It includes a three tiered annular recess 42 in the body member 22 arranged from largest to smallest toward the bottom of the recess 42. The smallest tier 44 at the bottom has a diameter at least as large as that of the bolt member head 32 and a depth also at least as large as the height of the head 32. A first shoulder 46 is defined between the smallest tier 44 and an intermediate tier 48.

A pair of locking jaws 50 are supported on the shoulder 46.

Figure 3:
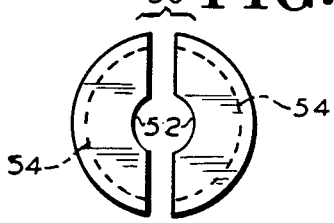
FIGS. 3–5 are view of components of the locking device shown in FIG. 2.
Figure 4:
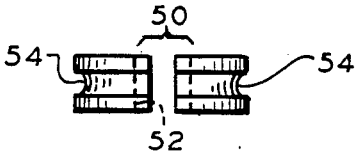
Figure 5:
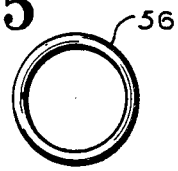

The locking jaws 50 (shown in FIGS. 3 and 4) ar the two halves of a split washer which comprise arcuate members having on their inner surface an arcuate surface 54 having a diameter equal to the first diameter of the bent member neck portion 30. A groove 54 is defined in the outer surface of the locking jaws 50 and an elastic O ring 56 (FIG. 5) is retained within the grooves 54 to bias the locking jaws 50 together.

A second shoulder 60 is defined between the intermediate tier 48 and the largest tier 62 and supports an annular retainer body 64 having a hole 66 therethrough of a diameter equivalent to the diameter of the bolt member upper portion 38. A retainer washer 68 (also having a hole diameter equivalent to the diameter of the bolt member upper portion 38) is secured above the retainer body 64 to maintain the assembly together. The retainer washer 68 may be secured by any suitable means, as by swedging the body member 22 onto the retainer washer 68.

Operation of the lock body structure 41a is as follows. The bolt member 24 is inserted into the lock body 22*a* so that the tapered portion 36 of the head 32 enters between the locking jaws 50. Pushing the bolt member 24 further causes the head tapered portion 36 to force the locking jaws 50 apart so that the head 32 passes between them. Once the head 32 is entirely in the smallest tier 44, the locking jaws 50 are snapped together by the O ring 56 to form a collar about the neck portion 30. Retraction of the bolt member 24 from the body member 22 is thereafter prevented by the abutting of the locking jaws 50 against the upper shoulder 34 of the bolt member head 32. Accordingly, the bolt member 24 and body member 22 cannot be separated without damaging some part of the device, which would provide visible evidence of tampering.

It is apparent from FIG. 2 that matching the sizes of the components (i.e., the head 32 with the smallest tier 44, the neck portion 30 with the locking jaws 50 and intermediate tier 46, and the upper portion 38 with the retainer body 64, largest tier 62 and washer 68) with respect to both height and diameter will provide for secure locking without play between the components. Still further, matching the sizes of the components helps to guard against the entry of small picking devices into the lock body 22*a*, as does the downwardly facing shoulder 40 which abuts the retainer washer 68 when locked, thereby making the lock virtually pickproof.

Figure 6:
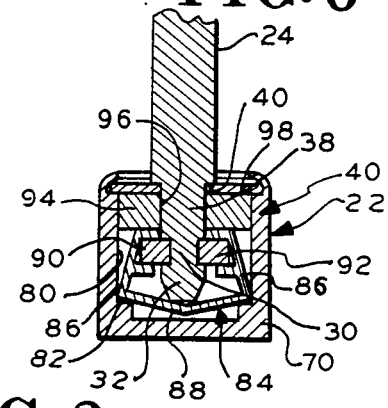
FIG. 6 is a cross-sectional view similar to FIG. 2 of an alternative embodiment of the lock body.

A second embodiment of the lock body structure 41b is shown in FIG. 6. The body member 70 has a two tiered annular recess 80, with the two tiers defining a narrow shoulder 82 around the recess 80. A U-spring 84 having upright legs 86 connected by a cross member 88 is supported on the shoulder 82. Supported on the top of each leg 86 is a cupped portion 90 within which a locking jaw 92 is located.

Figure 7:
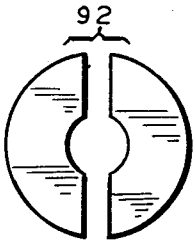
FIGS. 7–10 are views of components of the lock body illustrated in FIG. 6.
Figure 8:
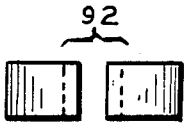

The locking jaws 92 are shown in FIGS. 7 and 8 and are similar to those previously described except that no groove is required in their outer surface.

Figure 9:
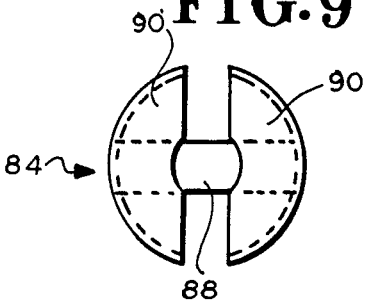
Figure 10:
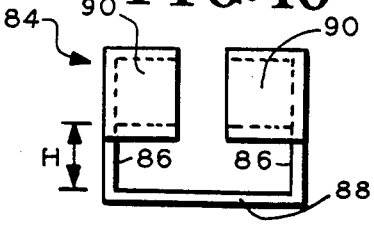

The U-spring 84 is shown in FIGS. 9 and 10. It supports the locking jaws 92 a distance H (see FIG. 10) above the cross member 88, which distance H is less than the height of the head 32 of the bolt member 24, for a reason which will become apparent. The U-spring 84 may be formed of plastic or any other material having the suitable resiliency.

Supported on top of the U-spring 84 within the recess 80 is a retainer body 94 having a hole 96 therethrough similar to the retainer body previously described. The retainer body 94 could alternatively be supported on a shoulder in the recess 80 as shown in FIG. 2. The entire assembly is also secured in the lock body 22 by a retainer washer 98 (also similar to that described with reference to FIG. 2) suitably secured to the body member 70, as by swedging the body member 70 onto the washer 98.

Accordingly, the lock body structure 41b of FIG. 6 functions as follows. The bolt member 24 is pushed into the body member 70 so that the head 32 forces its way between the locking jaws 92. Because the height of the head 32 is greater than the distance H, the end of the head 32 will engage the U-spring cross member 88 while part of the head 32 is still between the locking jaws 92. Therefore, the head 32 will push the center of the cross member 88 down, causing the legs 86 to be biased toward pivoting inwardly to bias the locking jaws 92 together. Once the head 32 is beneath the locking jaws 92, the locking jaws 92 snap together around the bolt member neck portion 30 to lock the bolt member 24 and body member 70 together. The downwardly facing shoulder 40 prevents the bolt member 24 from being pushed further into the body member 70, thereby protecting against damage to the U-spring 84.

Again, matching the size of the bolt member 24 and the lock body structure components will protect against picking of the locking device 20 and will also ensure that there is no play in the device 20 when locked to further protect against tampering.

Other embodiments of the locking device are shown in FIGS. 11–17. Although a particular embodiment of the lock body structure 41*a* or 41*b* is shown with some embodiments of the locking device for clarity, it should be understood that either a structure 41*a* as shown in FIG. 2 or a structure 41*b* as shown in FIG. 6 would be suitable for any of the locking devices.

Figure 11:
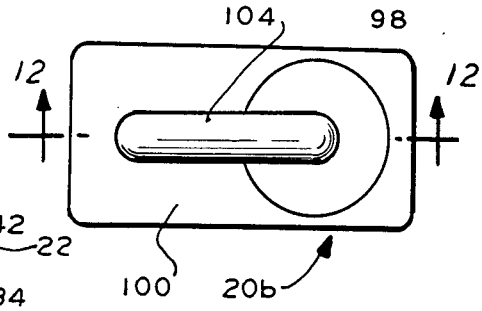
FIG. 11 is a top view of a second embodiment of the locking device.
Figure 12:
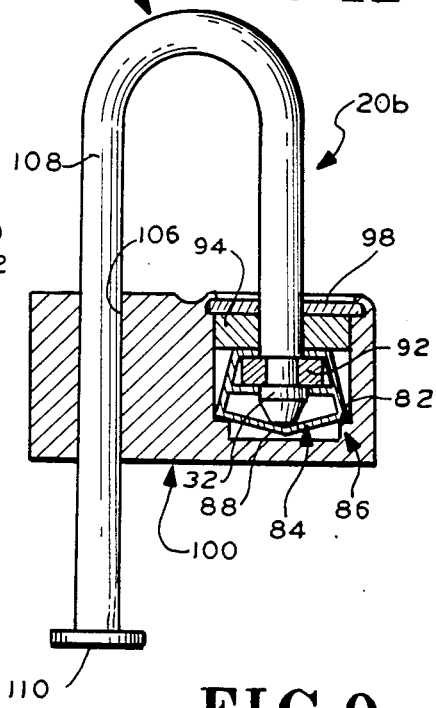
FIG. 12 is a cross-sectional view taken along line 12—12 of FIG. 11.

A padlock-type locking device 20*b* is shown in FIGS. 11 and 12. The bolt member 104 is a U-shaped shackle and the body member 100 includes a hole 106 therethrough in which the longer leg 108 of the bolt member 104 is slidably received. A head 110 is provided on the longer leg 108 of the bolt member 104 to retain the bolt member 104 within the lock body 22*c* even when not locked.

Figure 13:
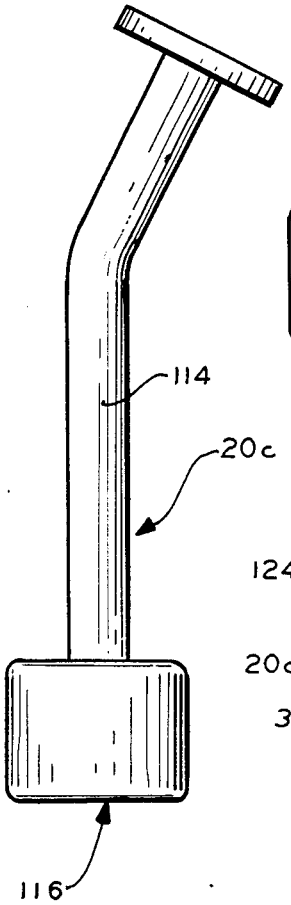
FIG. 13 is a view of a third embodiment of the locking device.

FIG. 13 shows a locking device 20*c* similar to that shown in FIG. 1 except that the bolt member 114 is bent, thereby making entry of the bolt member 114 into some latches easier. This locking device 20*c* can use a body member 116 identical to either of those shown in FIGS. 2 or 6.

Figure 14:
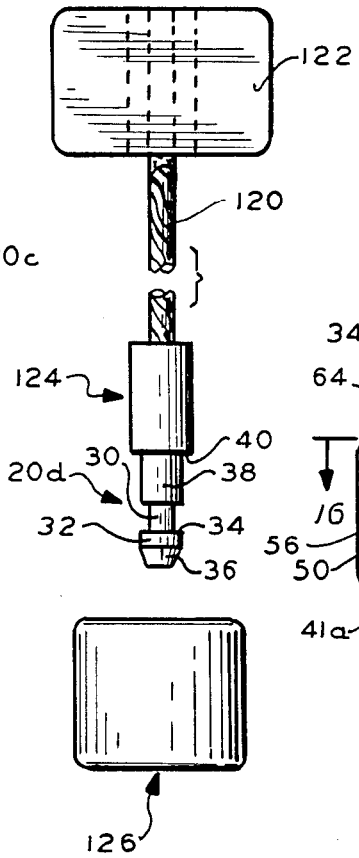
FIG. 14 is a view of a fourth embodiment of the locking device.

FIG. 14 shows a flexible locking device 20*d* which, like the embodiments shown in FIGS. 1 and 13, will secure an item between its ends. With the locking device 20*d* of FIG. 14, a cable 120 has a flag 122 suitably secured on one end, as by swedging the flag 122 over the cable 120, and also has a bolt end portion 124 suitably secured on its other end, again as by swedging the end portion 124 over the cable 120. The bolt end portion 124 locks within the body member 126 (which again may be identical to either of those shown in FIGS. 2 or 6) when inserted therein as previously described.

Figure 15:
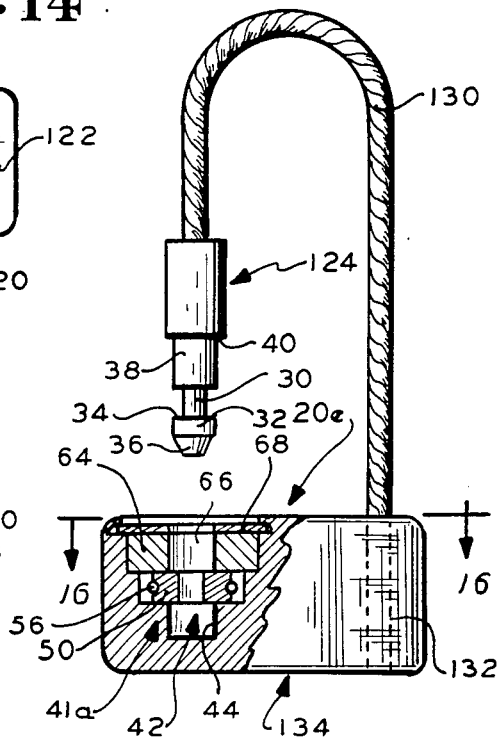
FIG. 15 is a partial cross-sectional view of a fifth embodiment of the locking device.
Figure 16:
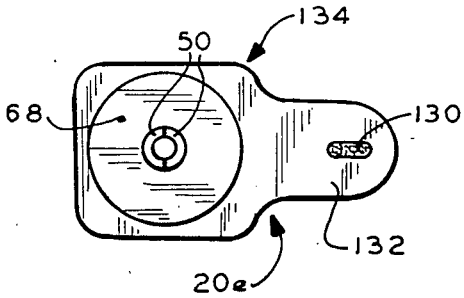
FIG. 16 is a view taken along line 16—16 of FIG. 15.

The locking device 20*e* shown in FIGS. 15 and 16 has a cable shackle 130 having high tensile strength, as for example a cable formed of wound steel strands. A bolt end portion 124 (like that shown in FIG. 14) is suitably secured on one end of the cable shackle 130 and a flange 132 of the body member 134 is suitably fixed to the opposite end (as by swedging the body member 134 around the cable shackle 130). Accordingly, the locking device 20*e* will form a closed loop (similar to the padlock type locking device 20*e* shown in FIGS. 11–12)

when the end portion 124 is locked in the body member 134.

Figure 17:
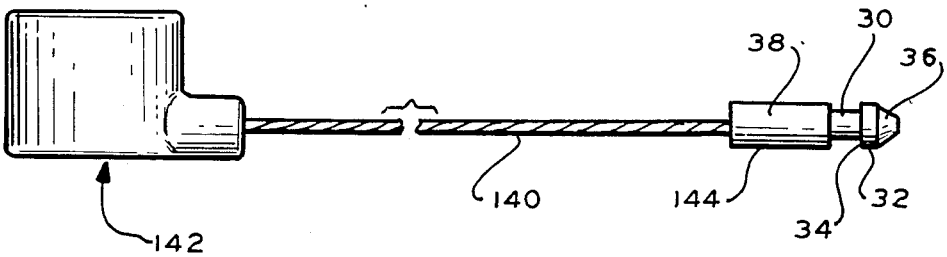
FIG. 17 is a view of a sixth embodiment of the locking device.

FIG. 17 shows a locking device 20*f* similar to that shown in FIGS. 15 and 16, with the major exception being that a relatively weak flexible trap 140 is secured on its ends to the body member 142 and a bolt end portion 144. The flexible strap 140 may consist of any number of materials, including, for example, plastic which could be cut with scissors. Though locking devices 20*f* of this type do not provide much security against forced entry, they are still useful as seals to be used in those situations where it is important that any unauthorized entry be detected. As with all of the other embodiments of the locking device, it is impossible to open this device 20*f* once locked without destroying some portion of the device 20*f* and thereby leaving clear visual evidence of the entry.

Locking devices as disclosed above provide a secure lock which is virtually pickproof, thereby requiring that the device 20 be destroyed in some manner to be opened once locked. Accordingly, these locking devices provide not only security against unauthorized entry, but they also ensure that there will be visual evidence if such entry does occur. Other aspects, objects and advantages of this invention will become apparent from a study of the drawings, specification and appended claims.

I claim:

1. A locking device comprising:

an elongate member having on one end a neck portion of a first diameter supporting a head of a second diameter greater than said first diameter to define a shoulder therebetween; and a lock body securable to said elongate member, said lock body including a body member having an annular recess therein, a retainer fixed to said body member to overlie said recess and having a hole therethrough at least as large as said second diameter, first and second locking jaws within said recess and movable between a first position providing an opening of said first diameter and a second position providing an opening of said second diameter, said locking jaws defining bottom surfaces substantially perpendicular to said elongate member when secured to said lock body, means for supporting said locking jaws above the bottom of said recess, and means for biasing said locking jaws toward said first position, whereby said locking jaws bottom surfaces abut against the elongate member shoulder when the elongate member and lock body are secured together.

2. The locking device of claim 1, wherein said elongate member comprises a rigid member having an enlarged section on its other end and a bend intermediate its ends.

3. The locking device of claim 2, wherein said bend is 180° and the end opposite said one end is slidably received within a hole in said lock body.

4. The locking device of claim 1, wherein said elongate member includes a flexible portion.

5. The locking device of claim 4, further comprising a flag member fixed to the other end of said elongate member.

6. The locking device of claim 4, wherein the other end of said elongate member is fixed to said lock body.

7. The locking device of claim 1, wherein said locking jaws form a collar around said neck portion when the device is locked.

8. The locking device of claim 1, wherein said supporting means and said biasing means comprise a U-spring with two legs interconnected by a cross member and supporting said locking jaws on respective legs of said spring.

9. The locking device of claim 8, further comprising a recess shoulder defined by a reduced diameter portion at the bottom of said recess, said cross member being supported by said recess shoulder.

10. The locking device of claim 9, wherein said leg members are shorter than the elongate member head so that said head bends said cross member between said recess shoulder to hold the leg members and supported locking jaws in said first position when the device is locked.

11. The locking device of claim 1, wherein said neck portion is supported on a first elongate member portion substantially as long as said retainer is thick and further comprising a second elongate member portion larger than the first member portion to define an end facing shoulder, said shoulder abutting said retainer when said device is locked.

* * * * *